US009140488B2

(12) United States Patent
Giardino et al.

(10) Patent No.: US 9,140,488 B2
(45) Date of Patent: Sep. 22, 2015

(54) VARIABLE DIFFERENTIAL AND OFFSET CONTROL FOR REFRIGERATION SYSTEMS

(75) Inventors: Nicholas M. Giardino, Gilberts, IL (US); Santhosh Kumar, Naperville, IL (US)

(73) Assignee: Cornelius, Inc., St. Paul, MN (US)

( * ) Notice: Subject to any disclaimer, the term of this patent is extended or adjusted under 35 U.S.C. 154(b) by 661 days.

(21) Appl. No.: 13/503,457

(22) PCT Filed: Oct. 25, 2010

(86) PCT No.: PCT/US2010/002831

§ 371 (c)(1), (2), (4) Date: Apr. 23, 2012

(87) PCT Pub. No.: WO2011/053347

PCT Pub. Date: May 5, 2011

(65) Prior Publication Data

US 2012/0210737 A1 Aug. 23, 2012

Related U.S. Application Data

(60) Provisional application No. 61/279,912, filed on Oct. 28, 2009.

(51) Int. Cl.

| | |
|---|---|
| ***F25D 29/00*** | (2006.01) |
| ***F25B 1/00*** | (2006.01) |
| ***F25B 49/00*** | (2006.01) |
| ***F25D 31/00*** | (2006.01) |

(52) U.S. Cl.

CPC ..... *F25D 29/00* (2013.01); *F25D 31/002* (2013.01); *F25B 2500/08* (2013.01); *F25B 2600/025* (2013.01); *F25B 2600/0251* (2013.01); *F25B 2600/0252* (2013.01)

(58) Field of Classification Search

CPC ..... F25B 2500/08; F25B 2600/025; F25B 2600/0251–2600/0252

USPC ..... 62/161, 163, 228.5

See application file for complete search history.

(56) References Cited

U.S. PATENT DOCUMENTS

| | | | | |
|---|---|---|---|---|
| 3,657,680 | A * | 4/1972 | Stegina et al. | 337/308 |
| 3,995,770 | A * | 12/1976 | Schwitters | 222/56 |
| 4,481,789 | A * | 11/1984 | Akimoto et al. | 62/209 |
| 5,647,220 | A * | 7/1997 | Kawaguchi et al. | 62/89 |
| 6,591,622 | B1 * | 7/2003 | Gherman et al. | 62/229 |
| 2004/0112070 | A1 | 6/2004 | Schanin | |
| 2004/0216474 | A1 | 11/2004 | Jablonski et al. | |
| 2008/0092566 | A1 | 4/2008 | Rand et al. | |
| 2008/0098761 | A1 | 5/2008 | Zangari et al. | |
| 2008/0149655 | A1 * | 6/2008 | Gist et al. | 221/1 |
| 2009/0187286 | A1 | 7/2009 | Magalhaes Medeiros Neto et al. | |
| 2009/0292395 | A1 | 11/2009 | DiFatta et al. | |

* cited by examiner

*Primary Examiner* — Frantz Jules
*Assistant Examiner* — Steve Tanenbaum
(74) *Attorney, Agent, or Firm* — Andrus Intellectual Property Law, LLP

(57) ABSTRACT

A beverage dispensing apparatus is characterized by a beverage dispenser and a refrigeration system for chilling beverage to be dispensed by the beverage dispenser. The refrigeration system has a compressor coupled to an evaporator for chilling the beverage, and a controller determines the amount of chilling that must be provided by the refrigeration system to chill the beverage and adjusts cut-in and cut-out beverage temperature set-points for the compressor accordingly. Advantageously, the cut-in and cut-out set-points are adjusted to beverage temperature values such that the chilling capacity of the refrigeration system is made to closely match to the amount of chilling required by the beverage, and also such that on/off cycles of the refrigeration system are decreased.

20 Claims, 4 Drawing Sheets

VARIABLE DIFFERENTIAL AND OFFSET CONTROL FOR REFRIGERATION SYSTEMS

This application is a U.S. National Stage application of international application No. PCT/US10/002831, filed Oct. 25, 2010, under the Patent Cooperation Treaty, which United States Patent Cooperation Treaty (PCT) Application claims priority and filing date from U.S. provisional application Ser. No. 61/279,912, filed Oct. 28, 2009.

FIELD OF THE INVENTION

The present invention relates to refrigeration systems, and in particular to refrigeration systems for beverage dispensers in which a controller variably adjusts temperature cut-in and cut-out set temperature points for a compressor in accordance with demands for beverage chilling.

BACKGROUND OF THE INVENTION

Depending upon the cooling load a refrigeration system is required to chill, the cooling demand placed on the system can vary widely. For example, when the refrigeration system serves the chilling requirements of a beverage dispenser, customer demand for beverages can vary from no drinks dispensed per minute to as many as 3 or 4 or more drinks dispensed per minute. This volatile variation in customer demand results in a broad range of cooling load requirements for the refrigeration system. When no beverages are being dispensed, the maintenance cooling load of a beverage dispenser can be as low as about 1500 Btu/hr. At the other extreme and during periods of high drink draw rates, cooling requirements can exceed 18,000 Btu/hr.

On-off operation of a compressor of a refrigeration system for a beverage dispenser is conventionally controlled by fixed temperature set-points that define a permissible range of beverage temperatures, ideally so that the beverage does not get either too warm or too cold and so that the refrigeration system compressor is not cycled on/off excessively. One set-point represents a maximum upper temperature that the beverage is permitted to reach before being chilled and the other set-point defines a minimum lower temperature of the beverage to be dispensed. When the refrigeration system compressor is off, the upper set-point is that temperature to which the beverage is allowed to warm before the compressor is cut-in or turned on to chill the beverage and reduce its temperature. The lower set-point is then that temperature to which the beverage is chilled before the compressor is cut-out or turned off. One problem with this technique is that it is not energy efficient. To conserve energy, it would be advantageous if beverage temperatures were allowed to be warmer during non-business hours than during business hours, but that cannot be accomplished with fixed upper and lower set-point temperatures. Another problem with the conventional approach is that fixed beverage temperature set-points constrain the refrigeration system compressor to operation between fixed cut-in and cut-out temperatures, irrespective of whether there are minimum or maximum cooling load demands being placed on the system. Consequently, when there is a minimum cooling load demand the refrigeration system cannot operate in a mode to conserve energy, and when there is a maximum cooling load demand the system cannot operate at an increased capacity to ensure that beverages are always properly chilled.

OBJECT OF THE INVENTION

A primary object of the present invention is to provide a variable differential and offset control for refrigeration systems for beverage dispensers, which variably adjusts the sensed beverage temperature set-points at which a refrigeration system compressor is cut-in and cut-out and the temperature differential between the set points in accordance with changes in chilling demands placed on the refrigeration system by the beverage dispenser.

SUMMARY OF THE INVENTION

In accordance with the invention, a beverage dispensing system comprises a beverage dispenser; means for delivering beverage to the beverage dispenser; a refrigeration system having a compressor and an evaporator heat transfer coupled to beverage to be chilled for dispensing by the beverage dispenser, the compressor having cut-in and cut-out beverage temperature set-points; means for sensing the amount of chilling required to be provided by the refrigeration system to chill beverage to be dispensed by the beverage dispenser; and a controller coupled to the sensing means and the refrigeration system for adjusting the value of at least one of the compressor cut-in and cut-out beverage temperature set-points in accordance with the sensed amount of chilling required to be provided by the refrigeration system to chill beverage to be dispensed by the beverage dispenser.

In various embodiments of the beverage dispensing system, the controller adjusts at least one of the cut-in and cut-out set-points to provide the refrigeration system with a chilling capacity that is in accordance with the sensed amount of chilling required to be provided by the refrigeration system; the sensing means includes means for sensing the temperature of beverage to be chilled and that is being chilled by the refrigeration system; the sensing means includes means for sensing the amount of beverage delivered to the beverage dispenser; the controller adjusts at least one of the refrigeration system compressor cut-in and cut-out set-points to provide a chilling capacity of the refrigeration system that decreases on/off cycles of the refrigeration system; and the controller variably adjusts the refrigeration system compressor cut-in and cut-out set-points by changing a beverage temperature differential between the cut-in and cut-out set-points.

The invention also provides a method of operating a beverage dispensing system comprising a beverage dispenser having a beverage dispensing valve and a refrigeration system having a compressor and an evaporator heat transfer coupled to beverage to be chilled for dispensing by the beverage dispenser valve, the compressor having cut-in and cut-out beverage temperature set-points and the method comprising the steps of delivering beverage along a flow path to and through the beverage dispenser to the beverage dispensing valve; sensing the amount of chilling required to be provided by the refrigeration system to chill beverage to be dispensed by the beverage dispensing valve; and adjusting the temperature value of at least one of the compressor cut-in and cut-out set-points in accordance with the sensed amount of chilling required to be provided by the refrigeration system to chill beverage.

According to various embodiments of the method, the adjusting step adjusts both the cut-in and the cut-out set-point; the sensing step includes sensing the temperature of beverage at one or more points along the flow path; the sensing step includes sensing the amount of beverage delivered to the beverage dispenser; the adjusting step adjusts the temperature value of at least one of the compressor cut-in and cut-out set-points to provide a chilling capacity of the refrigeration system that decreases on/off cycles of the refrigeration system; and the adjusting step adjusts the refrigeration system compressor cut-in and cut-out set-points by changing a beverage temperature differential between the set-points.

DETAILED DESCRIPTION

Conventional refrigeration systems for beverage dispensers normally operate with fixed value set-points that define upper and lower sensed beverage temperatures that are used to control cut-in and cut-out of a compressor of the refrigeration system. The arrangement is such that upon sensed beverage temperature increasing to a pre-selected maximum, the compressor cut-in or is turned on to operate the refrigeration system to chill the beverage. The refrigeration system then continues to chill the beverage until sensed beverage temperature decreases to a pre-selected minimum, at which point the compressor is cut-out or turned off to terminate chilling of the beverage, whereupon the cycle is repeated. Since in conventional refrigeration systems cut-in and cut-out beverage temperatures have pre-selected fixed values and remain unchanged for all the various cooling demands placed on the refrigeration system by the beverage dispenser, the refrigeration systems are not able to efficiently respond to changing cooling load requirements of beverage dispensers, either by decreasing capacity to conserve energy when a beverage dispenser is idle or by increasing capacity to satisfy an increased cooling load demand when drink draw rates increase.

Figure 1:
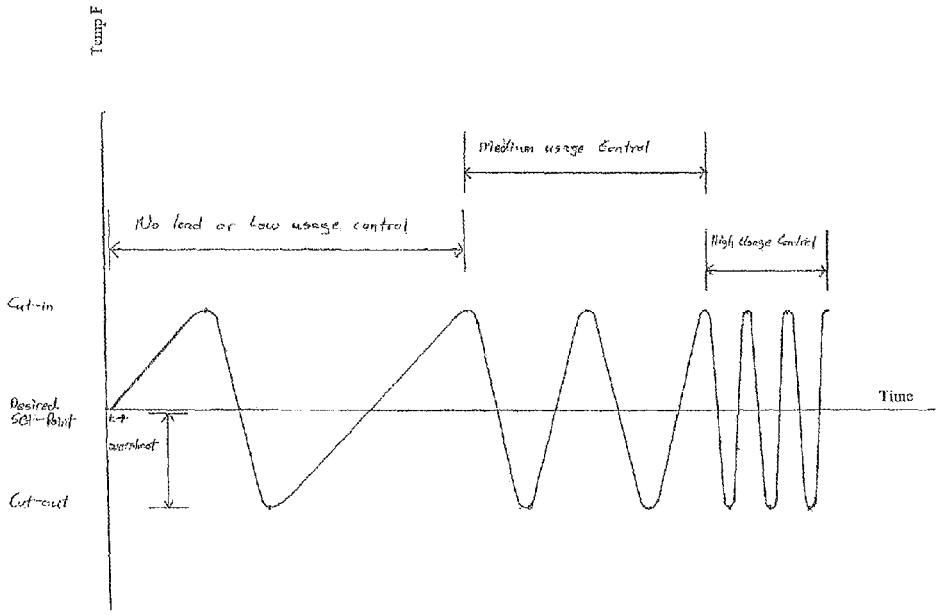
Fig. 1 (Prior Art)
FIG. 1 is a chart showing beverage temperatures versus time for low, medium and high drink draw rates of a beverage dispenser chilled by a refrigeration system having conventional fixed beverage temperature cut-in and cut-out set-points.

The FIG. 1 chart shows beverage temperature versus time for a beverage dispenser using a conventional refrigeration system having fixed set-points and in which the beverage dispenser places low, medium and high chilling loads on the refrigeration system. There is a single fixed upper temperature cut-in set-point that defines the maximum temperature the beverage is permitted to warm to before the refrigeration system compressor is turned on to chill the beverage, and a single fixed lower cut-out temperature set-point that defines the minimum temperature to which the beverage is chilled before the compressor is turned off. These upper and lower temperature set-points do not change with changes in the chilling demand placed on the refrigeration system by the beverage dispenser. A desired beverage temperature set-point can lie midway between the upper and lower set-points, and the temperature profile behavior of the beverage remains unchanged as drink draw rates change, except for changes in the time constant of the refrigeration system, i.e., the time interval from one compressor cut-in to the next, which time constant decreases with increasing drink draw rates and therefore increased chilling demands placed on the refrigeration system, and vice versa. The conventional on/off or cut-in/cut-out control is passive and reaction driven since it is strictly in accordance with sensed fixed beverage temperatures and reacts only once the temperature of the beverage has already reached the upper or lower limit. This type of conventional refrigeration system control can only result in changes in the time constant of the refrigeration system as it increases or decreases its cycles per hour in response to changes in drink draw rates and chilling demands, but it cannot change the cut-in and cut-out set-points and, thereby, the efficiency and capacity of the refrigeration system.

In overcoming the aforementioned disadvantages of conventional refrigeration systems, the invention provides a variable differential and offset control for a refrigeration system for a beverage dispenser, in which cut-in and cut-out beverage temperature set-points and the temperature differential between the set-points are variably controlled and changed based upon user input. If the beverage dispenser is frequently operated to dispense beverages, the set-points and temperature differential can be changed to lower values to operate the refrigeration system sooner and more continuously, i.e., to decrease the beverage temperature at which the refrigeration system compressor is cut-in and cut-out. If drink dispensing is not occurring, such as during an overnight idle period of the beverage dispenser, the temperature differential and set-points are changed to higher default values to increase the temperatures at which the refrigeration system compressor cuts-in and cuts-out, which conserves the energy required to operate the refrigeration system and improves the reliability of the system by minimizing wear and tear associated with compressor on/off cycles.

The variable temperature differential and offset control of the invention provides for utilization of increased refrigeration system capacity when called for by high drink dispense rates and decreased refrigeration system capacity when there are low drink draw rates or idle conditions of the beverage dispenser. This is accomplished by varying the refrigeration system temperature set-points in accordance with beverage dispense demands, and in particular in accordance with changing demands for beverage chilling as are placed on the refrigeration system by changing drink draw rates and temperatures of beverages being delivered to the beverage dispenser from supplies thereof. The control system provides for a refrigeration system to have an increased capacity when needed, yet allows the refrigeration system to have a lower capacity and to maintain warmer beverage temperatures during periods of low usage of the beverage dispenser or when the dispenser is idle or in standby mode, such as during overnight periods.

Figure 2:
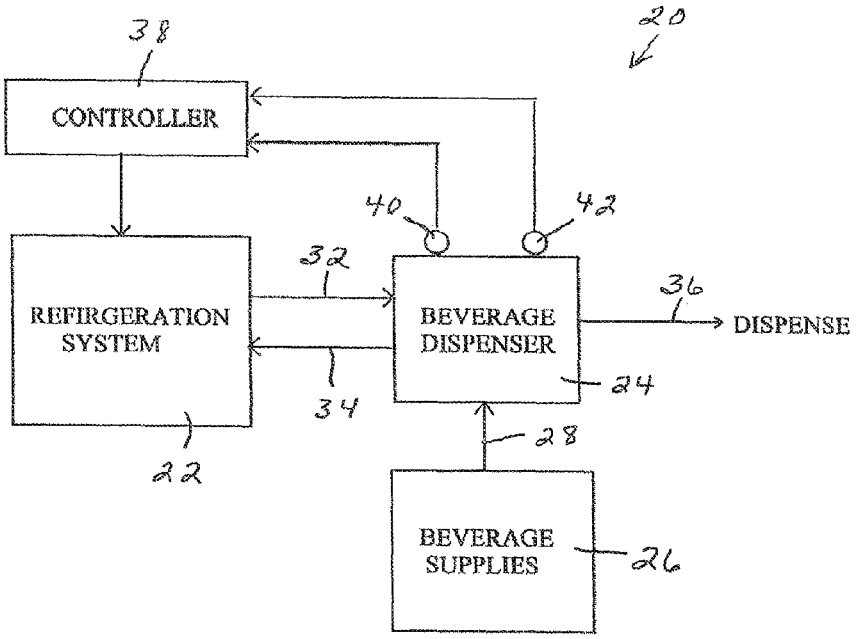
FIG. 2 is a block diagram of an apparatus embodying the present invention and comprising a beverage dispenser and a refrigeration system that is operated by a controller to have variable beverage temperature cut-in and cut-out set-points that are adjusted to be in accordance with the cooling load being placed on the refrigeration system by the beverage dispenser.
Figure 6:
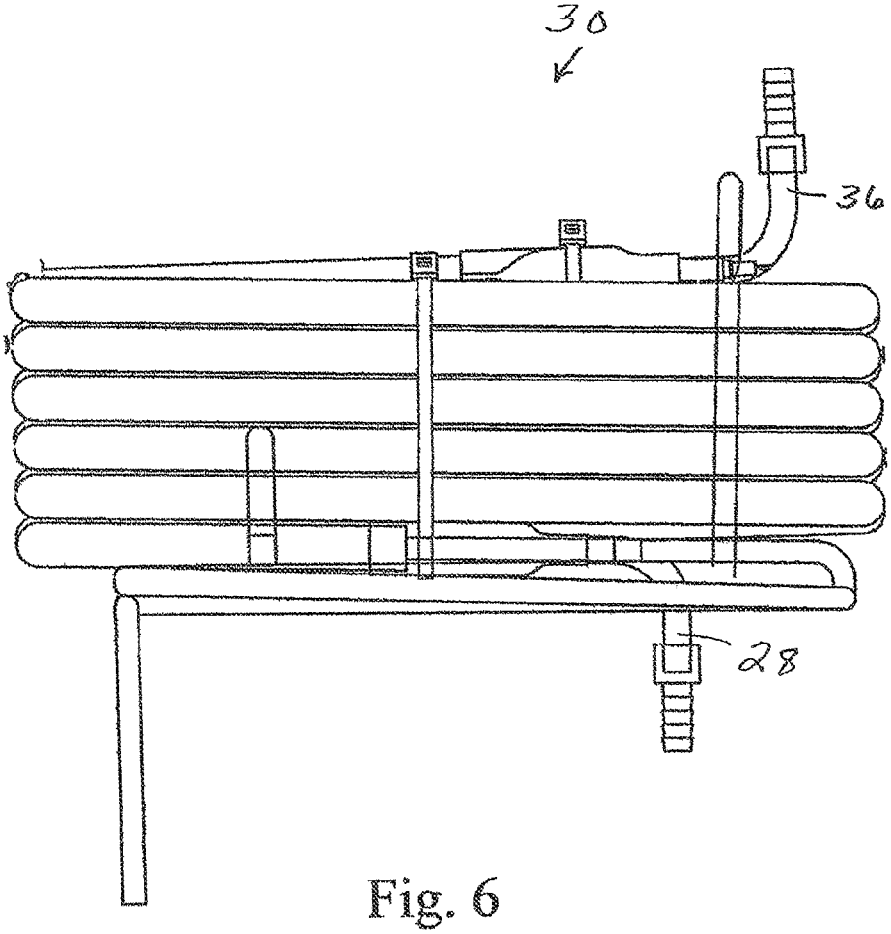
FIG. 6 is a pictorial view of a tube-in-tube heat exchanger of a type as may be used with the FIG. 2 apparatus to chill beverage.

FIG. 2 shows a beverage dispensing apparatus, indicated generally at 20, with which the teachings of the invention may be used. The apparatus includes a refrigeration system 22 that may be of a type as disclosed in U.S. patent application Ser. No. 12/454,821, filed May 22, 2009, published Nov. 26, 2009 as Publication No. US 2009/0292395 A1 and assigned to the assignee of the present invention, the teachings of which are incorporated herein by reference. The dispensing apparatus also includes a beverage dispenser 24 that receives relatively warm beverages from beverage supplies 26 through lines 28. The refrigeration system 22 has an evaporator, indicated generally at 30 in FIG. 6, a refrigerant inlet to which is coupled to an outlet from a compressor (not shown) of the refrigeration system through a high side refrigerant line 32 and a refrigerant outlet from which is coupled to a suction inlet to the compressor through a low side refrigerant line 34. The evaporator is heat transfer coupled to beverages in the beverage delivery lines 28 to chill the beverages and the chilled beverages are delivered from the beverage dispenser 24 to a beverage dispense point 36, such as to beverage dispense valves on a front of the dispenser for delivery of chilled beverages into cups upon user demand.

In accordance with the invention, the beverage dispensing apparatus 20 advantageously embodies a variable temperature differential and offset control implemented by a programmable controller 38. The controller variably adjusts one or both of the refrigeration system set-points, i.e., one or both of the beverage temperatures at which the refrigeration system compressor is cut-in and cut-out, in accordance with changing chilling demands placed on the refrigeration system 22 by the beverage dispenser 24, and/or that are anticipated to be placed on the refrigeration system by the beverage dispenser. Actual changes in chilling demand may be sensed by any suitable means, such as by sensing beverage temperatures with temperature sensing devices such as a thermocouple 40 that detects the temperature of beverage incoming to the beverage dispenser 24 from the beverage supplies 26 and a thermocouple 42 that detects the temperature to which beverage has been chilled by the refrigeration system. Alternatively and/or additionally, the chilling load placed on the refrigeration system can be monitored by sensing drink draw rates and the size of drinks drawn. Where beverage temperature sensing is used to determine the chilling load placed on the refrigeration system, then based upon the difference between incoming and chilled beverage temperatures and/or a change in the difference between incoming and chilled beverage temperatures, the controller can determine the chilling load being placed on the refrigeration system and establish appropriate set-points, or cut-in and cut-out beverage temperatures, for the refrigeration system compressor, in a manner to adjust refrigeration system capacity to be in accordance with the chilling demand to be met, so that beverage is brought to and maintained at a proper temperature for dispensing. Alternatively or additionally, the controller can sense the occurrence, frequency and size of drinks dispensed and make appropriate adjustments to compressor set-points based upon a calculated amount of chilling output from the refrigeration system that will be required to properly chill the relatively warm replacement beverage incoming to the beverage dispenser 24 from the beverage supplies 26. Thus, based upon the value of the inputs it receives, the controller 38 determines the appropriate adjustment to be made to the beverage temperature set-points for cut-in and cut-out of the refrigeration system compressor, which determination can be made by implementation of an appropriate algorithm or through use of a look-up table.

Figure 3:
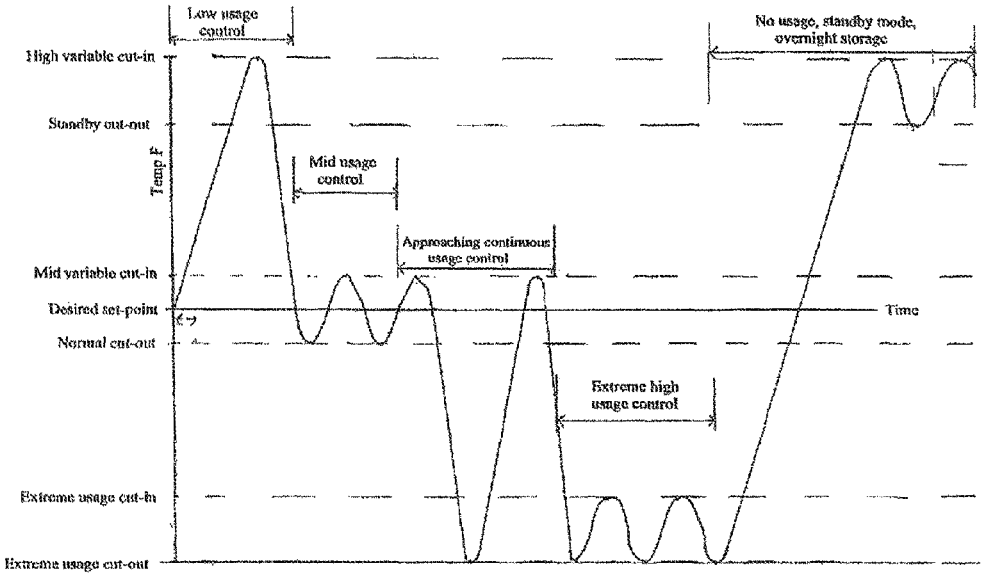
FIG. 3 is a graph showing operation of the FIG. 2 system and the manner in which the controller changes the cut-in and cut-out set-points of the beverage dispenser in response to changes in cooling loads placed by the beverage dispenser on the refrigeration system.

FIG. 3 graphically illustrates one representative implementation of the chilling demand variable differential control of the invention, as may be used with the dispensing apparatus 20. As is seen, in response to changes in chilling demands placed on the refrigeration system 22 by the beverage dispenser 24, as determined by sensed beverage temperatures either alone or in combination with monitored drink draw rates, the controller 38 variably adjusts the beverage temperature set-points of the refrigeration system as needed to adjust and match the capacity of the refrigeration system to the chilling being demanded of it. As chilling demand increases, one or both of the upper and lower the set-points are decreased, which can include changing the temperature differential between the set-points, to increase the capacity of the refrigeration system to meet the increased chilling demand. On the other hand, as chilling demand decreases, one or both of the upper and lower set-points are increased, which can include changing the temperature differential between the set-points, to decrease the capacity of the refrigeration system to be substantially no more than is needed to satisfy the decreased chilling demand. For the situation where the chilling demand decreases because of a standby or idle condition of the beverage dispenser, the adjustment to one or both of the upper and lower set-points is such as to provide a higher average beverage temperature in order to limit operation of the refrigeration system and reduce energy consumption of the apparatus 20 when there is no demand for beverages, such as during overnight periods. In this connection and where the apparatus 20 is to be idle, the variable temperature differential and offset controller 38 can include timer means to initiate reduction of one or both of the beverage temperature set-points toward the end of the idle period in order to reduce average beverage temperature in contemplation of upcoming drink dispensing. The variable set-point and differential control of the invention is considerably more active than a conventional control and in operation changes refrigeration system set-points and overall system capacity in a manner resulting in fewer on/off cycles of the compressor, which decreases the wear and tear associated with compressor cycling and increases overall refrigeration system reliability and efficiency.

In the FIG. 3 implementation of the variable differential and offset control of the invention, six different beverage temperature set-points are provided, three compressor cut-in set-points and three compressor cut-out set-points. Three of the six set-points are above or at a temperature greater than a desired beverage temperature and three are below or at a temperature less than the desired beverage temperature. The three set-points above the desired beverage temperature are: (1) a high variable compressor cut-in beverage temperature, which is a variable maximum temperature the beverage is allowed to reach before the refrigeration system 22 is turned on and compressor cut-in occurs; (2) a standby compressor cut-out beverage temperature that is at a temperature below and colder than the high variable cut-in temperature; and (3) a mid variable compressor cut-in beverage temperature that is at a temperature below and colder than the standby cut-out temperature. The three set-points at temperatures below the desired beverage temperature are: (4) a normal compressor cut-out beverage temperature that is colder than the mid variable cut-in beverage temperature; (5) an extreme usage compressor cut-in beverage temperature that is colder than the normal cut-out temperature; and (6) an extreme usage compressor cut-out beverage temperature that is colder than the extreme usage cut-in temperature and represents the lowest temperature to which the beverage is allowed to be chilled before the refrigeration system 22 is turned off and compressor cut-out occurs. While a total of six compressor cut-in and cut-out set-points are indicated in FIG. 3, three above and three below a desired beverage temperature, it will be appreciated that depending upon the level of control desired over adjustment of refrigeration system capacity, fewer or more set-points may be utilized by the controller 38.

As seen in FIG. 3, during periods of low usage of the beverage dispensing apparatus 20, when few beverages are being dispensed, the refrigeration system compressor is turned on when beverage temperature rises to the high variable compressor cut-in point and is turned off when the beverage is chilled sufficiently that its temperature falls to the normal compressor cut-out point. Because the high compressor cut-in point is variable, it can be increased or decreased depending upon where the actual drink draw rate falls within the range of drink draw rates considered as low usage of the beverage dispenser. Naturally, upward adjustment of the maximum temperature beverage is allowed to reach before compressor cut-in occurs is limited in order to avoid service to a customer of a beverage that has not been sufficiently chilled, and the normal compressor cut-out temperature is selected to have a value that limits compressor on/of cycling during periods of low usage of the beverage dispenser 24.

During periods of mid usage of the beverage dispenser 24, which mid usage is greater than low usage, the compressor cut-in set-point is reduced to the mid variable beverage temperature and the compressor cut-out set-point remains at the normal beverage temperature. By reducing the compressor cut-in point to the mid variable beverage temperature, refrigeration system capacity is increased and the average temperature of the beverage is reduced, so that when the compressor is off during a mid usage period, the beverage is not permitted to warm to a point that an insufficiently chilled drink might be drawn. Because the mid cut-in set-point is variable, it can be increased or decreased depending upon where the actual drink draw rate falls within the range of drink draw rates considered as mid usage. During mid usage periods, the time constant of the refrigeration system 22 decreases and refrigeration system capacity increases.

During periods approaching continuous usage of the beverage dispenser 24, compressor cut-in remains at the mid variable cut-in temperature and compressor cut-out is reduced to the extreme usage cut-out temperature. By reducing the compressor cut-out point to the extreme usage beverage temperature, refrigeration system capacity is increased and average beverage temperature is decreased relative to the refrigeration system capacity and average beverage temperature that exist at the mid usage level. The apparatus 20 is thereby better able to dispense properly chilled beverages, even at an increased and almost continuous drink draw rate. Because the mid compressor cut-in temperature is variable, it can be increased or decreased depending upon where the actual drink draw rate falls within the range of drink draw rates considered as approaching continuous, so that refrigeration system capacity can be better matched to the actual chilling demand then being placed on the refrigeration system. There is, however, a maximum temperature for the mid variable cut-in that cannot be exceeded in order to avoid the potential of beverage temperature increasing to a point where an insufficiently chilled drink could be served.

During periods of extreme high usage of the beverage dispenser 24, the compressor cut-in point is reduced to the extreme usage cut-in beverage temperature and the compressor cut-out point remains at the extreme usage cut-out beverage temperature. By reducing the compressor cut-in point to the extreme usage beverage temperature, the beverage is chilled to a low temperature and is not allowed to warm significantly, so that refrigeration system capacity and average beverage temperature are reduced relative to refrigeration system capacity and average beverage temperature that exist at the continuous usage level. This serves to enhance rapid chilling of relatively warm replacement beverage delivered to the beverage dispenser 24 from the beverage supplies 26 as beverages are dispensed at a high drink draw rate.

During periods when the beverage dispenser 24 is on standby and not being used, such as during overnight periods when it is idle, it is not necessary to maintain as low an average beverage temperature as is maintained during periods when drink dispensing occurs. However, the beverage must be kept sufficiently cold to avoid health concerns arising from spoilage. Accordingly, during such periods compressor cut-in is set at the high variable beverage temperature and compressor cut-out is increased to the standby beverage temperature, which keeps the beverage cold enough to prevent spoilage yet warm enough that compressor usage is limited to conserve energy.

Where the beverage to be chilled is a sugared beverage, representative temperatures for the various cut-in and cut-out set-points can be in the range of +/−1° F. of those shown in the following table, thereby to prevent overlap of the temperatures:

| | |
|---|---|
| High variable cut-in | 45° F. |
| Standby cut-out | 42° F. |
| Mid variable cut-in | 39° F. |
| Normal cut-out | 37° F. |
| Extreme usage cut-in | 35° F. |
| Extreme usage cut-out | 33° F. |

It is to be understood, however, that practice of the invention is not limited to use of such temperatures for cut-in and cut-out set points, and that the mentioned +/−1° F. range of such temperatures can be increased if the set-point temperatures are selected such that overlap of the set-points would not occur. In particular, the set-point temperatures can have various different values depending upon the particular application in which they will be applied for controlling a machine.

Figure 4:
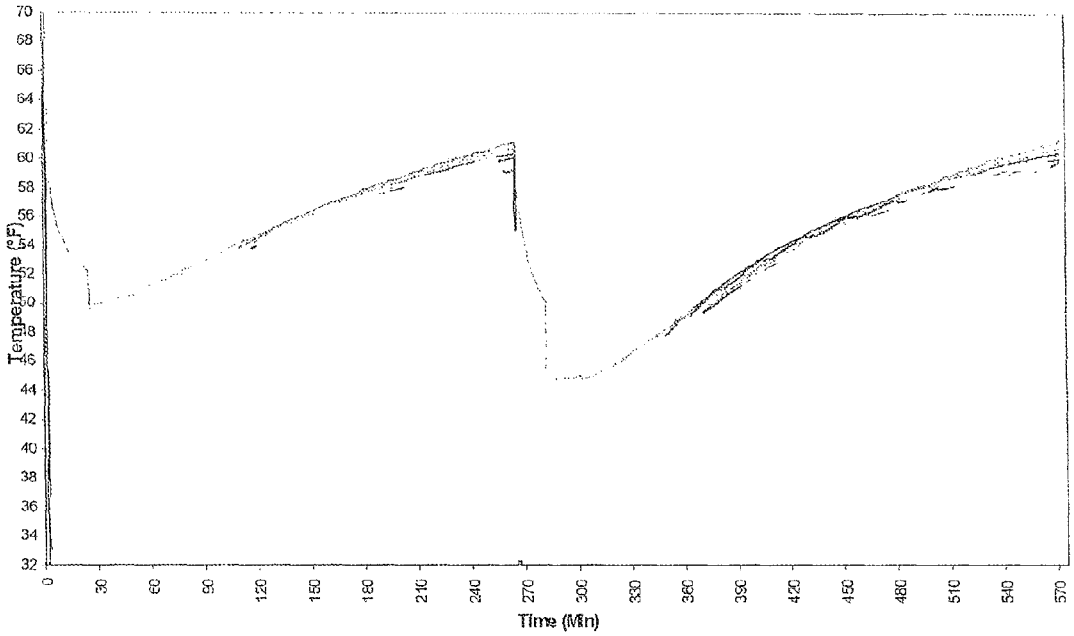
FIG. 4 is a graph showing beverage temperature versus time for the condition of the FIG. 2 apparatus in which the beverage dispenser is idle and no drinks are being drawn.

FIG. 4 shows changes in beverage temperature as may occur over time when the beverage dispenser is idle and drinks are not being drawn. Only during the relatively short periods of decreasing beverage temperature is the compressor cut-in and using energy. The remainder of the time, during the relatively long periods of increasing beverage temperature, the compressor is cut-out and uses no energy.

Figure 5:
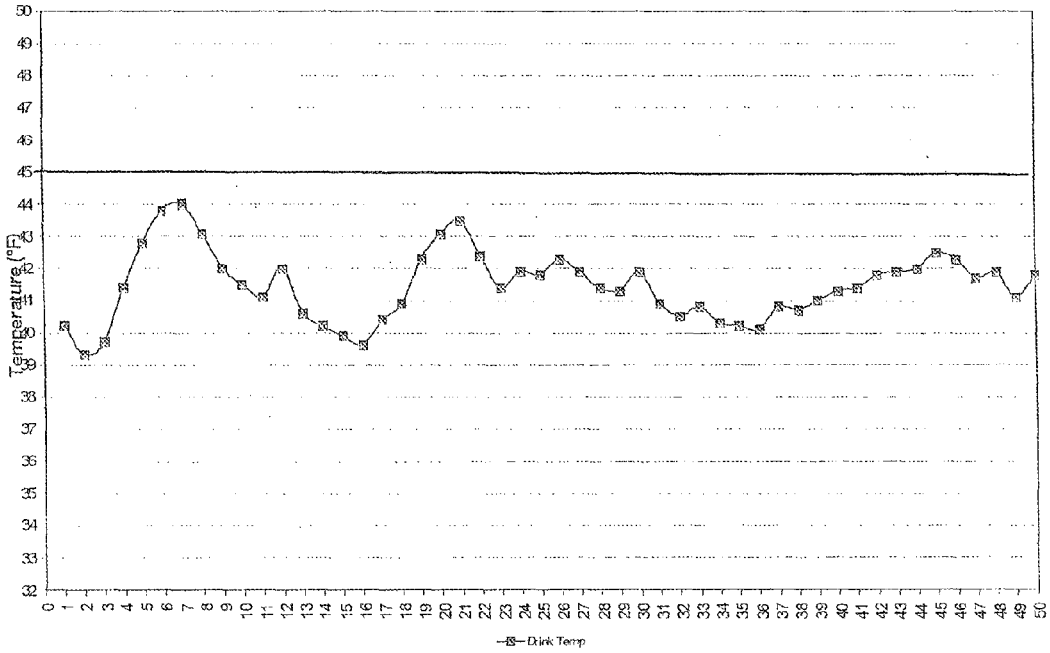
FIG. 5 is a graph showing beverage temperature change versus the number of drinks dispensed by the FIG. 2 apparatus.

FIG. 5 shows, for one representative operation of the beverage dispensing apparatus 20, beverage temperature versus the number of drinks drawn at generally regular intervals.

Chilling of relatively warm beverage delivered from the beverage supplies 26 to the beverage dispenser 24 is accomplished by heat transferring coupling an evaporator of the refrigeration system 22 to the beverage in any of numerous manners well known to those skilled in the art. For the purpose of describing the present invention, beverage chilling can occur through use of the evaporator 30 of FIG. 6. The evaporator may be of any suitable configuration and as shown is formed as a coil or helix, and cold refrigerant in the evaporator is heat transfer coupled to beverage delivered to the beverage dispenser 24 from the beverage supplies 26. For this purpose, the beverage delivery line 28 may be configured complimentary to the evaporator and be heat transfer coupled to the evaporator within the beverage dispenser, either by being placed in heat transfer contact with an exterior of the evaporator or by using a tube in tube arrangement in which the evaporator extends through an interior of the beverage line, or vice versa. The temperature sensing device 40, which may be a thermocouple, can be located to detect the temperature of beverage in the line 28 before it begins to be chilled by the evaporator 30 and the temperature sensing device 42, which may also be a thermocouple, can be located to detect the temperature of beverage after it has been chilled by the evaporator.

The invention provides an improved beverage dispensing apparatus in which a refrigeration system for a beverage dispenser has its compressor controlled by variable cut-in and cut-out set-points having values determined in accordance with sensed beverage temperatures and/or drink dispense rates. The cut-in and cut-out set-points are, chosen to provide a variable chilling capacity and efficient operation of the refrigeration system, such that the chilling capacity is closely matched to the chilling demand of the beverage dispenser to ensure that a continuous supply of properly chilled beverage is always available for service. In essence, operation of the beverage dispensing apparatus is adjusted, as required, based on user inputs.

Variable differential control of the cut-in and cut-out set-points of the refrigeration system 22 allows customer behavior to impact drink dispensing apparatus performance. As customer demand for product dispense increases, the controller 38 runs the refrigeration system more often and at an increased capacity. This is achieved by varying the compressor run time with a differential control algorithm that is only utilized when customers demand drinks be dispensed. As the demand for drinks lapses, such as during overnight hours, the controller operates the refrigeration system less often and at a decreased capacity by reverting to a differential control scheme that prevents the drink dispenser 24 from over-refrigerating the product.

The invention embodies a control scheme for saving energy by reducing overall run time as lower drink demands dictate. With lower drink demand there is lower energy consumption and attendant increased reliability of the refrigeration system due to a reduction in on/off cycles of refrigeration system components. The controller 38 allows the refrigeration system 22 to remain in a standby state until customers demand drink dispensing. The standby state allows the beverage dispensing apparatus 20 to be ready to dispense chilled drinks when demand is increased as well as to keep beverages cool enough to meet product and quality specifications without creating reliability issues for the product.

In practice of the invention, the temperature of a beverage or juice is variably controlled as it is dispensed. This is accomplished with a beverage dispensing apparatus that generally embodies a refrigeration system; a refrigeration system controller; a means for demanding beverage dispensing (e.g., a push-button, lever, etc.); thermocouples heat transfer coupled to the beverage at various locations for sensing beverage temperature and for providing beverage temperature feedback to the refrigeration system controller; a power supply; and system logic for the controller to vary refrigeration system capacity by controlling the operating profile or set-points for the refrigeration system compressor, as required by the chilling demand of the dispensing apparatus. In essence, the refrigeration system controller varies refrigeration system capacity by changing the cut-in and cut-out set-points of the refrigeration system compressor as deemed necessary by the demand for beverages. In changing the compressor cut-in and cut-out set-points, the controller not only changes the beverage temperatures for the cut-in and cut-out set-points, but also changes the differential between the cut-in and cut-out set-points if and as necessary as required by the demand being placed on the apparatus.

While embodiments of the invention have been described in detail, various modifications and other embodiments thereof may be devised by one skilled in the art without departing from the spirit and scope of the invention, as defined in the appended claims.

What is claimed is:

1. A method of operating a beverage dispensing system comprising a beverage dispensing valve and a refrigeration system having a compressor and an evaporator that is heat transfer coupled to a beverage to be dispensed via the beverage dispensing valve, wherein the beverage dispensing system has a cut-in beverage temperature set point that represents a maximum temperature that the beverage to be dispensed via the beverage dispensing valve is permitted to reach before the compressor is turned on and a cut-out beverage temperature set point that represents a minimum temperature that the beverage to be dispensed via the beverage dispensing valve is permitted to reach before the compressor is turned off, the method comprising:

sensing a temperature of the beverage to be dispensed via the beverage dispensing valve;

sensing an amount or rate of beverage being dispensed via the beverage dispensing valve;

calculating a cooling load demand on the beverage dispensing system based upon the temperature of the beverage to be dispensed via the beverage dispensing valve and the amount or rate of beverage being dispensed via the beverage dispensing valve; and adaptively changing the cut-in beverage temperature set point and the cut-out beverage temperature set-point based upon the cooling load demand on the beverage dispensing system.

2. The method according to claim 1, further comprising adaptively changing the cut-in beverage temperature set point and the cut-out beverage temperature set-point so as to decrease a number of on/off cycles of the beverage dispensing system during, a time of relatively low cooling load demand on the beverage dispensing system and increase a number of on/off cycles of the beverage dispensing system during a time of relatively high cooling load, demand on the beverage dispensing system.

3. The method according to claim 1, further comprising adaptively changing the cut-in beverage temperature set point and the cut-out beverage temperature set-point so as to reduce an amount energy used by the beverage dispensing system when the amount or rate of beverage being dispensed via the beverage dispensing valve decreases and to increase capacity of the beverage dispensing system when the amount or rate of beverage being dispensed via the beverage dispensing valve increases.

4. The method according to claim 3, further comprising adaptively changing a temperature differential between the cut-in beverage temperature set point and the cut-out beverage temperature set-point based upon the cooling load demand on the beverage dispensing system;

increasing the temperature differential when the amount or rate of beverage being dispensed via the beverage dispensing valve decreases; and decreasing the temperature differential when the amount or rate of beverage being dispensed via the beverage dispensing valve increases.

5. The method according to claim 1, further comprising adaptively changing a temperature differential between the cut-in beverage temperature set point and the cut-out beverage temperature set-point based upon the cooling load demand on the beverage dispensing system.

6. The method according to claim 5, further comprising increasing the temperature differential when the amount or rate of beverage being dispensed via the beverage dispensing valve decreases and decreasing the temperature differential when the amount or rate of beverage being dispensed via the beverage dispensing valve increases.

7. The method according, to claim 6, further comprising decreasing the temperature differential after a predetermined amount of time passes from when the amount or rate of beverage being dispensed via the beverage dispensing valve decreases.

8. The method according to claim 6, further comprising increasing the temperature differential after a predetermined amount of time passes from when the amount or rate of beverage being dispensed via the beverage dispensing valve increases.

9. The method according to claim 1, further comprising, adaptively changing the cut-in beverage temperature set point and the cut-out beverage temperature set-point based upon the cooling load demand on the beverage dispensing system only when the temperature of the beverage to he dispensed via the beverage dispensing valve is between a fixed upper temperature cut-in set point and a fixed lower temperature cut-in set point.

10. The method according to claim 1, further comprising further sensing a temperature of a beverage that is added to the beverage dispensing system, calculating a difference between the temperature of the beverage to be dispensed via the beverage dispensing valve and the temperature of the beverage that is added to the system, and calculating the cooling load demand on the beverage dispensing system based at least in part upon the difference.

11. A method of operating a beverage dispensing system comprising a beverage dispensing valve and a refrigeration system having a compressor and an evaporator that is heat transfer coupled to a beverage to be dispensed via the beverage dispensing valve, wherein the beverage dispensing system has a cut-in beverage temperature set point that represents a maximum temperature that the beverage to be dispensed via the beverage dispensing valve is permitted to reach before the compressor is turned on and a cut-out beverage temperature set point that represents a minimum temperature that the beverage to be dispensed via the beverage dispensing valve is permitted to reach before the compressor is turned off the method comprising:

sensing a temperature of the beverage to be dispensed via the beverage dispensing valve;

sensing an amount or rate of beverage being dispensed via the beverage dispensing valve:

calculating a cooling load demand on the beverage dispensing system based upon the temperature of the beverage to be dispensed via the beverage dispensing valve and the amount or rate of beverage being dispensed via the beverage dispensing valve; and adaptively changing the cut-in beverage temperature set point and the cut-out beverage temperature set-point based upon the cooling load demand on the beverage dispensing system only when the temperature of the beverage to be dispensed via the beverage dispensing. valve is between a fixed upper temperature cut-in set point and a fixed lower temperature cut-in set point.

12. The method according to claim 11, further comprising adaptively changing the cut-in beverage temperature set point and the cut-out beverage temperature set-point so as to decrease a number of on/off cycles of the beverage dispensing system during time periods of relatively low cooling, load demand on the beverage dispensing system and increase a number of on/off cycles of the beverage dispensing system during the time periods of relatively high cooling load demand on the beverage dispensing system.

13. The method according to claim 11, further comprising adaptively changing the cut-in beverage temperature set point and the cut-out beverage temperature set-point so as to reduce an amount energy used by the beverage dispensing system when the amount or rate of beverage being dispensed via the beverage dispensing valve decreases and to increase capacity of the beverage dispensing system when the amount or rate of beverage being dispensed via the beverage dispensing valve increases.

14. The method according to claim 13, further comprising adaptively changing a temperature differential between the cut-in beverage temperature set point and the cut-out beverage temperature set-point based upon the cooling load demand on the beverage dispensing system;

increasing the temperature differential when the amount or rate of beverage being, dispensed via the beverage dispensing valve decreases; and decreasing the temperature differential when the amount or rate of beverage being dispensed via the beverage dispensing valve increases.

15. The method according to claim 11, further comprising adaptively changing a temperature differential between the cut-in beverage temperature set point and the cut-out beverage temperature set-point based upon the cooling load demand on the beverage dispensing system.

16. The method according to claim 15, further comprising increasing the temperature differential when the amount or rate of beverage being dispensed via the beverage dispensing, valve decreases and decreasing the temperature differential when the amount or rate of beverage being dispensed via the beverage dispensing valve increases.

17. The method according to claim 16, further comprising decreasing the temperature differential after a predetermined amount of time passes from when the amount or rate of beverage being dispensed via the beverage dispensing valve decreases.

18. The method according, to claim 16, further comprising increasing the temperature differential after a predetermined amount of time passes from when the amount or rate of beverage being dispensed via the beverage dispensing valve increases.

19. The method according to claim 11, further comprising further sensing a temperature of a beverage that is added to the beverage dispensing system, calculating a difference between the temperature of the beverage to be dispensed via the beverage dispensing valve and the temperature of the beverage that is added to the system, and calculating the cooling load demand on the beverage dispensing, system based at least in part upon the difference.

20. A method of operating a beverage dispensing system comprising a beverage dispensing valve and a refrigeration system having a compressor and an evaporator that is heat transfer coupled to a beverage to be dispensed via the beverage dispensing valve, wherein the beverage dispensing system has a cut-in beverage temperature set point that represents a maximum temperature that the beverage to be dispensed via the beverage dispensing valve is permitted to reach before the compressor is turned on and a cut-out beverage temperature set point that represents a minimum temperature that the beverage to be dispensed via the beverage dispensing valve is permitted to reach before the compressor is turned off, the method comprising;

sensing a temperature of the beverage to be dispensed via the beverage dispensing valve;

sensing an amount or rate of beverage being dispensed via the beverage dispensing valve;

calculating a cooling load demand on the beverage dispensing system based upon the temperature of the beverage to be dispensed via the beverage dispensing valve and the amount or rate of beverage being dispensed via the beverage dispensing valve;

adaptively changing the cut-in beverage temperature set point and the cut-out beverage temperature set-point based upon the cooling load demand on the beverage dispensing system only when the temperature of the beverage to be dispensed via the beverage dispensing valve is between a fixed upper temperature cut-in set point and a fixed lower temperature cut-in set point, adaptively changing a temperature differential between the cut-in beverage temperature set point and the cut-out beverage temperature set-point based upon the cooling load demand on the beverage dispensing system;

increasing the temperature differential when the amount or rate of beverage being dispensed via the beverage dispensing valve decreases so as to decrease a number of on/off cycles of the beverage dispensing system during, a time of relatively low cooling load demand on the beverage dispensing system; and decreasing the temperature differential when the amount or rate of beverage being dispensed via the beverage dispensing valve increases so as to increase a number of on/off cycles of the beverage dispensing system during a time of relatively high cooling load demand on the beverage dispensing system.

* * * * *